US008177268B2

(12) United States Patent
Varney et al.

(10) Patent No.: US 8,177,268 B2
(45) Date of Patent: May 15, 2012

(54) LEVER-HANDLE LOCK

(75) Inventors: Jim R Varney, Maynard, MA (US); Bryan R Hotaling, Harvard, MA (US)

(73) Assignee: Cosco Management, Inc., Wilmington, DE (US)

( * ) Notice: Subject to any disclaimer, the term of this patent is extended or adjusted under 35 U.S.C. 154(b) by 513 days.

(21) Appl. No.: 12/370,025

(22) Filed: Feb. 12, 2009

(65) Prior Publication Data

US 2010/0199727 A1 Aug. 12, 2010

(51) Int. Cl.
*E05C 19/18* (2006.01)
*E05C 19/00* (2006.01)

(52) U.S. Cl. ..... 292/297; 292/298; 292/336.3; 292/347

(58) Field of Classification Search ..... 292/297, 292/290, 298, 336.3, DIG. 2, 347, 348; 70/179, 70/180, 207, 209–211, 432, 436, 441
See application file for complete search history.

(56) References Cited

U.S. PATENT DOCUMENTS

| | | | | |
|---|---|---|---|---|
| 2,471,315 | A | 5/1949 | Dehmel | |
| 2,939,308 | A * | 6/1960 | Trammell, Jr. | 70/210 |
| 4,196,602 | A * | 4/1980 | Akselsen | 70/211 |
| 4,319,470 | A | 3/1982 | White | |
| 4,920,773 | A | 5/1990 | Surko, Jr. | |
| 4,969,673 | A | 11/1990 | Portelli et al. | |
| 5,303,965 | A | 4/1994 | Meehan | |
| 5,408,853 | A | 4/1995 | Yamada | |
| 6,048,007 | A | 4/2000 | Shor | |
| 6,105,406 | A * | 8/2000 | Thompson et al. | 70/416 |
| 6,386,602 | B1 | 5/2002 | Lan | |
| 6,484,542 | B1 | 11/2002 | Klingler | |
| 6,807,833 | B1 | 10/2004 | Huang et al. | |
| 6,929,292 | B1 | 8/2005 | Galindo et al. | |
| 7,048,315 | B2 | 5/2006 | Wong | |
| 7,311,342 | B1 | 12/2007 | Fan | |
| 7,334,824 | B2 | 2/2008 | Sundberg et al. | |
| 7,416,230 | B2 * | 8/2008 | Konstantakis et al. | 292/288 |

FOREIGN PATENT DOCUMENTS

| | | |
|---|---|---|
| DE | 292348 | 6/1916 |

* cited by examiner

*Primary Examiner* — Carlos Lugo

(74) *Attorney, Agent, or Firm* — Barnes & Thornburg LLP

(57) ABSTRACT

A lever-handle lock includes a stationary support base adapted to mount to a door around a lever handle carried on the door. The lever-handle lock also includes a lever-handle rotation blocker mounted on the stationary support base to block selectively rotation of the lever handle relative to the stationary support base at the option of a user.

22 Claims, 9 Drawing Sheets

LEVER-HANDLE LOCK

BACKGROUND

The present disclosure relates to a latch for a door, and in particular, to a lever-handle latch. More particularly, the present disclosure relates to a lock configured to block rotation of the lever-handle latch that controls the opening and closing of the door.

SUMMARY

A lever-handle lock in accordance with the present disclosure includes a stationary support base adapted for mounting on a door to surround a lever handle carried on the door and a lever-handle rotation blocker mounted on the stationary support base to block rotation selectively of the lever handle about a rotation axis. The lever-handle rotation blocker is configured to rotate about the rotation axis between a door-locking position wherein the door is kept in mating contact with a door frame and a door-unlocking position wherein the door is freed to move out of mating contact with the door frame.

In illustrative embodiments, the lever-handle lock further includes a blocker-movement controller configured to allow a user to control the movement of the lever-handle rotation blocker. The blocker-movement controller includes a rotation lock coupled to the lever-handle rotation blocker for normally anchoring the lever-handle rotation blocker to the stationary base in a lever-rotation blocking position. The blocker-movement controller also includes a rotation-lock actuator configured to provide means for moving the rotation lock out of engagement with the stationary support base to free the lever-handle rotation blocker to rotate about the rotation axis in response to rotation of the lever handle about the rotation axis from the door-locking position to the door-unlocking position.

In illustrative embodiments, the rotation lock includes an anchor arranged to extend into an anchor receiver formed in the stationary support base and an anchor return configured to apply a biasing force to the anchor to urge the anchor out of engagement with the anchor receiver. In illustrative embodiments, the user moves the anchor by engaging an anchor mover included in the actuator means. The anchor mover is coupled to the lever-handle rotation blocker and is arranged to extend through a slot formed in a top wall of the lever-handle rotation blocker. A position guide, also included in the actuator means, is appended to an interior surface of the lever-handle rotation blocker and is configured to engage and retain the anchor mover in the lever-rotation blocking position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 10 is an enlarged plan view of a portion of the lever-handle lock of FIGS. 1 and 2 showing that the anchor-mover button is positioned at the top of the arcuate slot formed in the C-shaped lever-handle motion barrier and showing that a portion of the button-cover plate is visible through the curved slot communicating to the user that the blocker anchor is in the lever-handle rotation blocking position by a visible closed-lock icon;

FIG. 11 is a sectional view taken along line 11-11 of FIGS. 2 and 10 showing that the anchor is in the lever-rotation blocking position and showing that an anchor pin included in the anchor has engaged an anchor receiver formed in the blocker carrier, and showing the anchor-mover button is retained in place by a position guide appended to an inner surface of the lever-handle motion barrier;

FIG. 12 is a sectional view similar to FIG. 11 showing that a thumb of a user is applying an actuation force to the anchor-mover button to cause the anchor-mover button to move away from the position guide toward the barrier mount and suggesting movement of the anchor-mover button in a counter-clockwise direction in the arcuate slot will move the anchor-mover button past the position guide as suggested in FIGS. 13 and 14;

FIG. 13 is an enlarged plan view of a portion of the lever-handle lock of FIG. 3 showing that the anchor-mover button is at locked-end stop of the arcuate slot and showing that a portion of the button-cover plate is visible to the user and communicating that the anchor is in the lever-rotation unblocking position by a visible opened-lock icon;

FIG. 14 is a sectional view taken along line 14-14 of FIGS. 3 and 13 showing that the thumb has maintained the actuation force while the anchor-mover button was moved in the counter-clockwise direction away from the position guide so that when the actuation force is removed, the anchor may assume the lever-rotation unblocking position suggested in FIG. 15;

FIG. 15 is a view similar to FIG. 14 showing that the anchor pin has been urged upwardly toward the lever-handle motion barrier by a pair of return springs thereby causing the anchor pin to be withdrawn from the anchor receiver in the blocker carrier and suggesting that the lever-handle motion barrier is free to move in either the clockwise direction or the counter-clockwise direction by the two phantom arrows;

DETAILED DESCRIPTION

Figure 1:
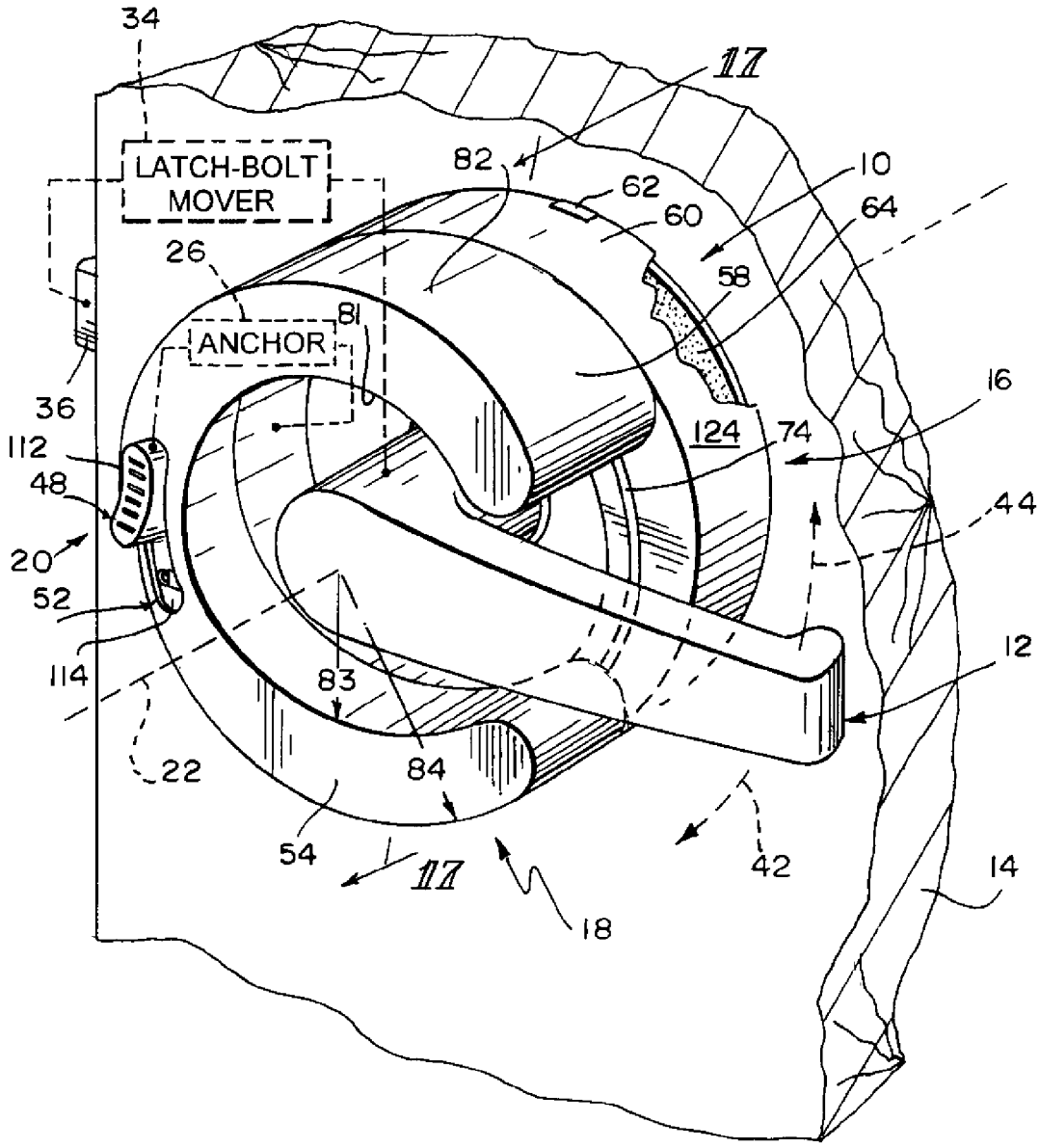
FIG. 1 is a perspective view of a lever-handle lock for securing doors carrying a latch system including a rotatable lever handle, a retractable latch bolt, and a latch-bolt mover coupled to the lever handle and the latch bolt, the lever-handle lock including a ring-shaped base, a C-shaped lever-handle motion barrier mounted on the ring-shaped base for selective rotation, and a rotation lock including an anchor for normally anchoring the C-shaped lever-handle motion barrier to the ring-shaped base in a lever-rotation blocking position as shown in FIG. 1 and an anchor-mover button configured to extend through a curved slot formed in the C-shaped lever-handle motion barrier and to move the anchor relative to the ring-shaped base to free the C-shaped lever-handle motion barrier for counter-clockwise and clockwise rotation as suggested in FIGS. 4 and 5 so that the rotatable lever handle is free to rotate about a rotation axis perpendicular to the door to retract the latch bolt into a cavity formed in the door.

A lever-handle lock 10 in accordance with the present disclosure is shown in FIG. 1. Lever-handle lock 10 includes a blocker-support base 16 adapted for mounting on a door 14 to surround a lever handle 12 carried on door 14 and a lever-handle rotation blocker 18 mounted on blocker-support base 16 to block rotation selectively of lever handle 12 about a rotation axis 22. Lever-handle rotation blocker 18 is configured to rotate about rotation axis 22 between a door-locking position (FIGS. 1-3) wherein door 14 is kept in mating contact with a door frame 40 and a door-unlocking position (FIGS. 4 and 5) wherein door 14 is freed to move out of mating contact with door frame 40.

Figure 8:
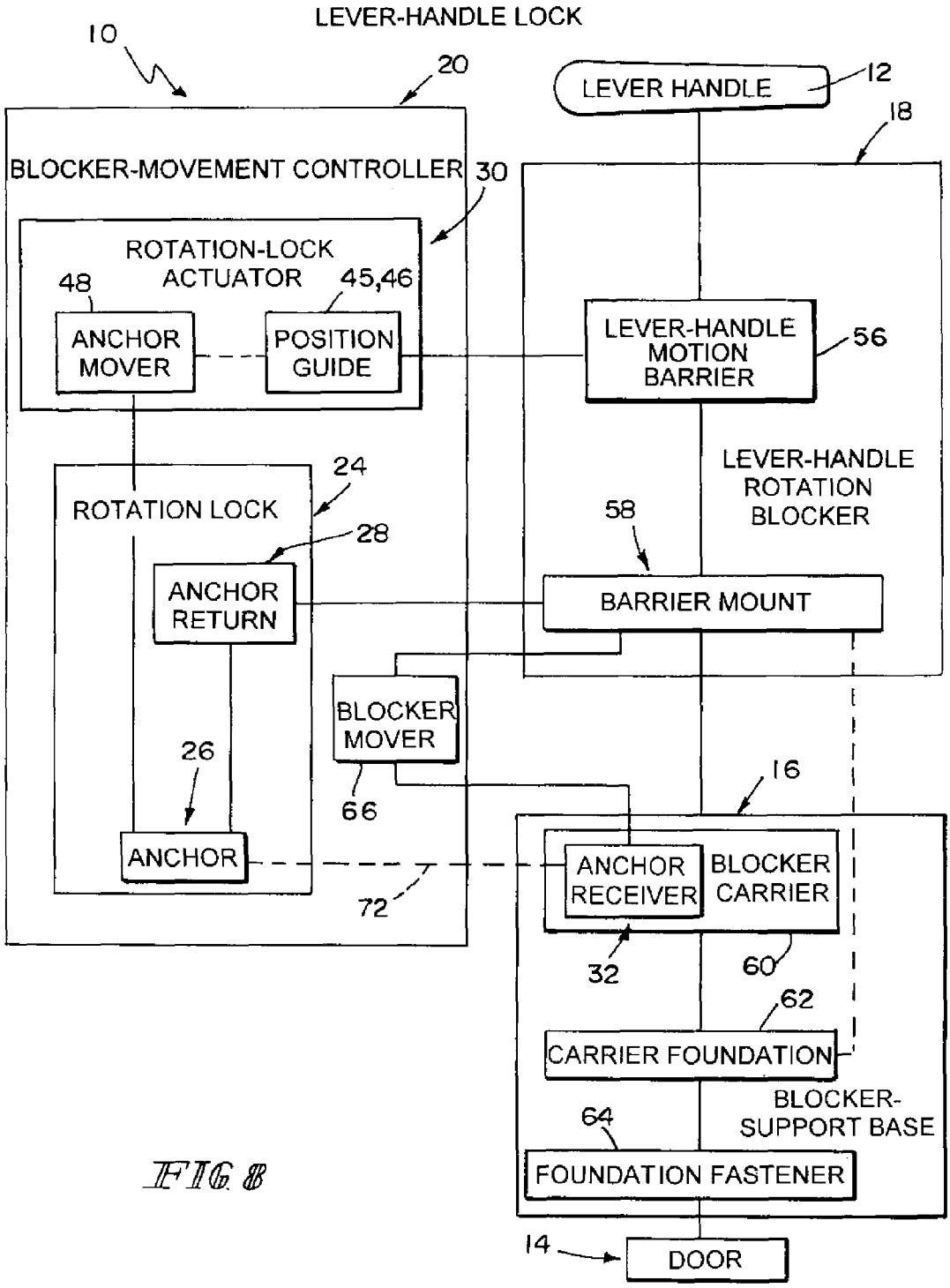
FIG. 8 is a diagrammatic view of a lever-handle lock, in accordance with the present disclosure, the lever-handle lock including a lever-handle rotation blocker including a lever-handle motion barrier and a barrier mount, a blocker-support base including a blocker carrier and a stationary carrier foundation, and a blocker-movement controller including a blocker mover, a rotation-lock actuator, and a rotation lock cooperating to block selectively rotation of the lever-handle rotation blocker relative to the blocker-support base as suggested in FIGS. 10-15.

Lever-handle lock 10 further includes a blocker-movement controller 20 illustrated in FIG. 8 and shown in illustrative operation in FIGS. 10-15. Blocker-movement controller 20 is configured to allow a user to control the movement of lever-handle rotation blocker 18. Blocker-movement controller 20 includes a rotation lock 24 that includes an anchor 26 and an anchor return 28 configured to provide a biasing force 158 on anchor 26 and a rotation-lock actuator 30 configured to provide means for moving anchor 26 against biasing force 158 to cause anchor 26 to move out of anchor receiver 32 to free lever-handle rotation blocker 18 to rotate about rotation axis 22 in response to rotation of lever handle 12 about rotation axis 22 from the door-locking position to the door-unlocking position.

Illustratively, a hand 50 of the user first engages rotation-lock actuator 30 and moves anchor 26 from a lever-rotation blocking position (FIGS. 2, 10, and 11) wherein anchor 26 is arranged to extend into anchor receiver 32 formed in blocker-support base 16 to a lever-rotation unblocking position (FIGS. 3, 13, and 15) wherein anchor 26 is positioned to lie in spaced-apart relation to anchor receiver 32. Hand 50 then applies a user-supplied torque to lever handle 12 to cause lever-handle rotation blocker 18 to move from the door-locking position (FIGS. 1-3) to the door-unlocking position (FIGS. 4 and 5) allowing door 14 to move out of mating contact with door frame 40.

Figure 9:
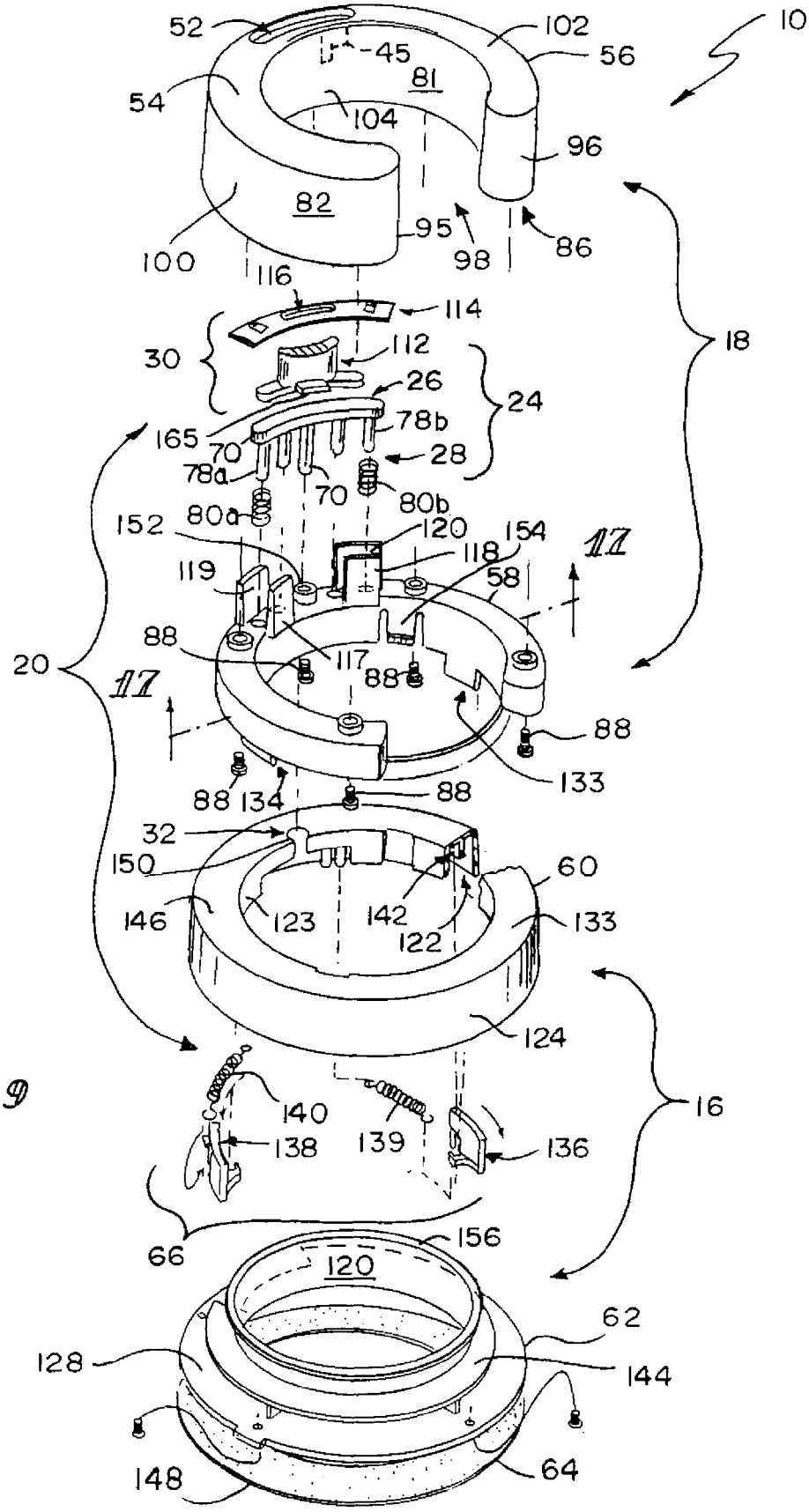
FIG. 9 is an exploded perspective view of the lever-handle lock of FIG. 1 showing the lever-handle lock includes, from top to bottom, a C-shaped lever-handle motion barrier, an anchor mover including a button-cover plate and an anchor-mover button, an anchor, a pair of return springs, a barrier mount, a blocker-support base including a blocker carrier, a stationary carrier foundation, and a foundation fastener, and a blocker mover positioned to lie between the blocker carrier and the stationary carrier foundation.

Rotation-lock actuator 30, as suggested in FIGS. 8 and 9, includes a position guide 46 and an anchor mover 48. Position guide 46, as shown in FIGS. 11, 12, 14, and 15, is appended to lever-handle rotation blocker 18 to engage and retain anchor mover 48 in the appropriate position. Anchor mover 48 is coupled to lever-handle rotation blocker 18 and arranged to extend away from blocker support base 16 through a first slot 52 formed in a top wall 54 of lever-handle rotation blocker 18 as shown in FIG. 1.

Figure 2:
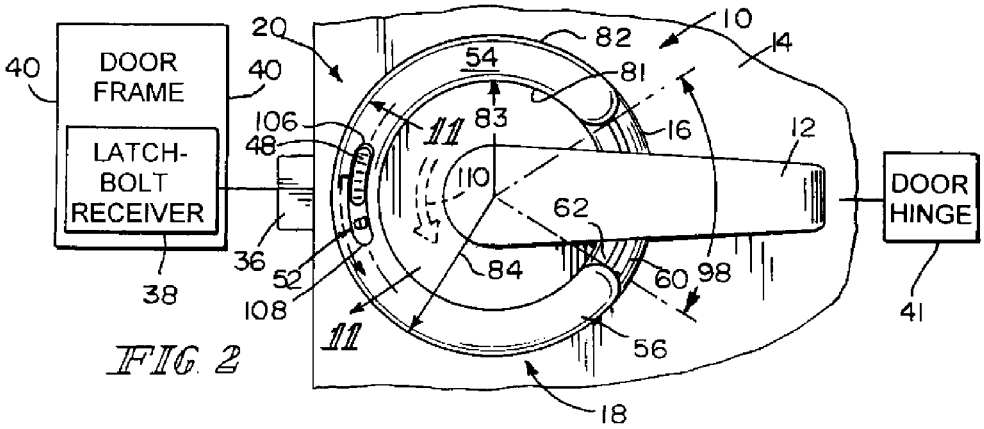
FIG. 2 is a plan view of the lever-handle lock of FIG. 1 showing that the rotation lock of the lever-handle lock is in the lever-rotation blocking position thereby blocking movement of the rotatable lever handle and suggesting that movement of the rotation-lock actuator in a counter-clockwise direction (phantom arrow) will establish a lever-rotation unblocking position of the anchor as suggested in FIG. 3.
Figure 3:
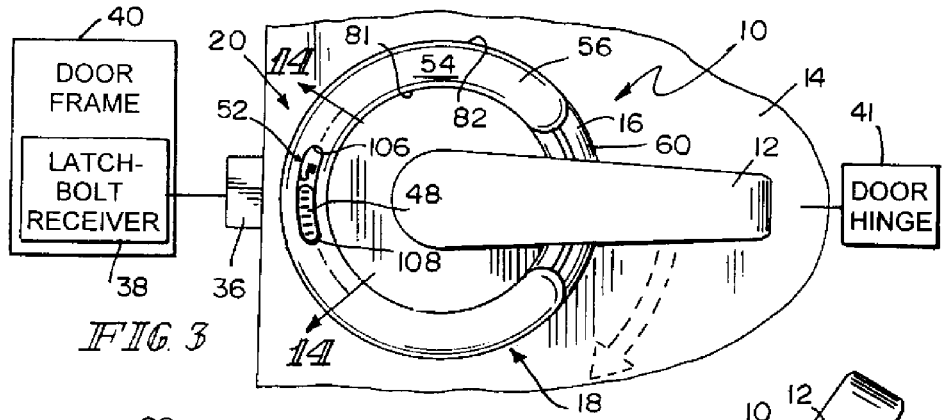
FIG. 3 is a view similar to FIG. 2 showing that the anchor is in the lever-rotation unblocking position thereby allowing the rotatable lever handle to move relative to the blocker-support base to cause the latch bolt to retract into the cavity formed in the door to establish a door-unlocking position as suggested in FIGS. 4 and 5.
Figure 4:
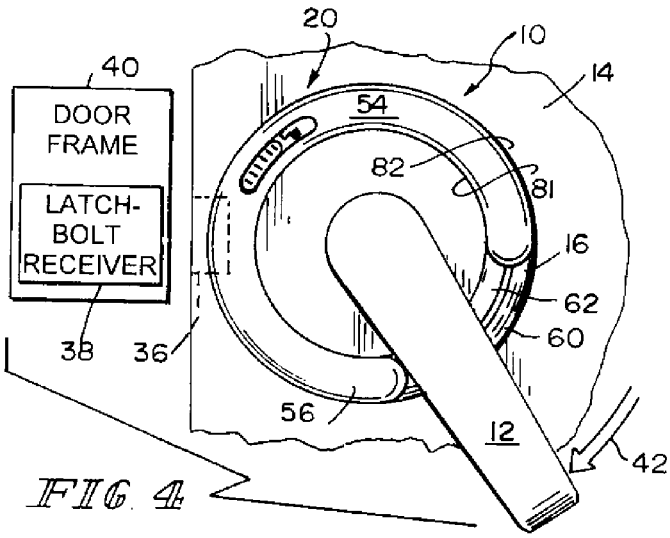
FIG. 4 is a view similar to FIG. 3 showing that the rotatable lever handle has been rotated in a clockwise direction by a lever-displacement force (solid arrow) causing the latch bolt to retract from the latch-bolt receiver into the cavity formed in the door.
Figure 5:
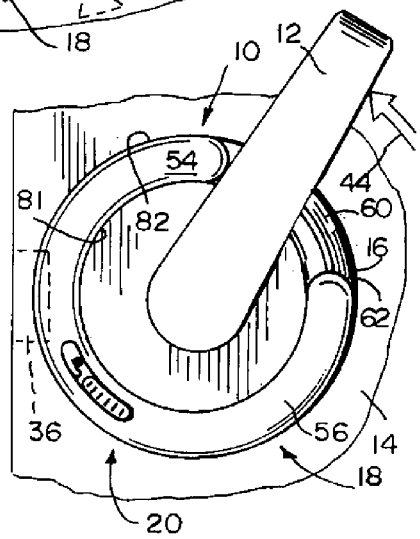
FIG. 5 is a view similar to FIG. 4 showing the rotatable lever handle rotated in a counter-clockwise direction by the lever-displacement force (solid arrow) to the door-unlocking position.

Lever-handle rotation blocker 18 is mounted on blocker-support base 16 to rotate about rotation axis 22 between the door-locking position shown in FIGS. 2 and 3 and the door-unlocking position shown in FIGS. 4 and 5. When lever-handle rotation blocker 18 is in the door-locking position, lever handle 12 is blocked from rotating about rotation axis 22 thereby keeping a latch-bolt mover 34 from withdrawing a latch bolt 36 from a mating latch-bolt receiver 38 formed in a door frame 40 as suggested in FIGS. 2 and 3. When lever-handle rotation blocker 18 is in the door-unlocking position, lever handle 12 has rotated about rotation axis 22 in one of a clockwise direction 42 and a counter-clockwise direction 44 to cause latch-bolt mover 34 to withdraw latch bolt 36 out of mating contact with latch-bolt receiver 38 allowing door 14 to rotate on a door hinge 41 and open.

Lever-handle rotation blocker 18, as shown in FIG. 9, includes a lever-handle motion barrier 56 and a barrier mount 58. Barrier mount 58 is mounted for rotation about rotation axis 22 on blocker-support base 16. Lever-handle motion barrier 56 is coupled to barrier mount 58 to move therewith and is configured to engage and restrict movement of lever handle 12 from the door-locking position when anchor 26 is in the lever-rotation blocking position. Lever-handle motion barrier 56 is further configured to rotate with lever handle 12 when anchor 26 is in the lever-rotation unblocking position.

As shown in FIG. 9, blocker-support base 16 includes a blocker carrier 60, a stationary carrier foundation 62, and a foundation fastener 64. Foundation fastener 64 is arranged to interconnect stationary carrier foundation 62 to door 14. Blocker carrier 60 is coupled to and cooperates with stationary carrier foundation 62 to support and retain lever-handle rotation blocker 18 during rotation between the door-locking position and the door unlocking position as suggested in FIGS. 3-5.

Blocker-movement controller 20 further includes a blocker mover 66 as suggested in FIG. 8 and shown in FIG. 9 that is configured to provide means for providing a biasing torque 164 (FIG. 18) to barrier mount 58 to cause lever-handle motion barrier 56 to move from the door-unlocking position toward the door-locking position so the user can use rotation-lock actuator 30 to move anchor 26 from the lever-rotation unblocking position to the lever-rotation blocking position. As suggested in FIG. 9, blocker mover 66 is positioned to lie within a blocker-mover space found between stationary carrier foundation 62 and blocker carrier 60 as suggested in FIG. 8.

Figure 11:
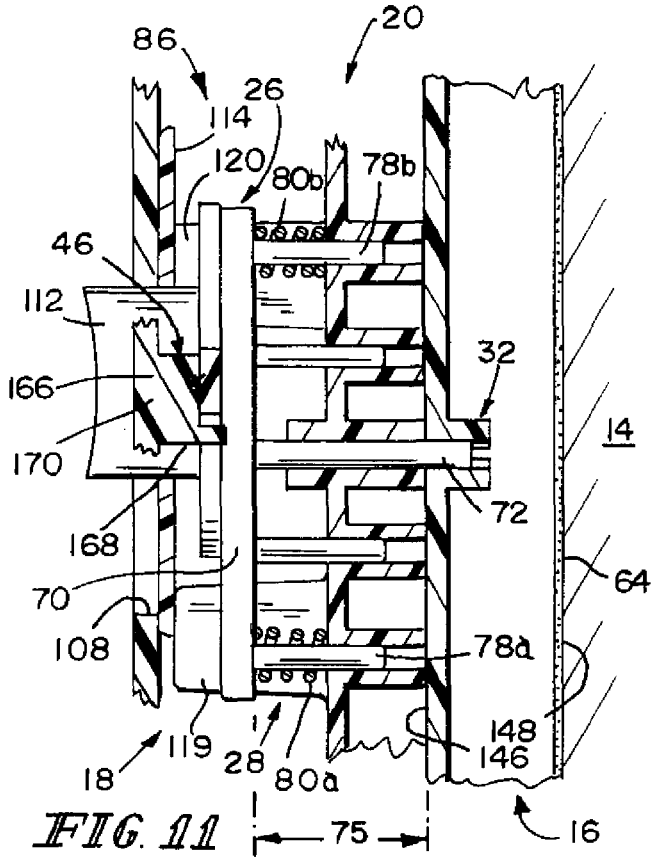
Figure 15:
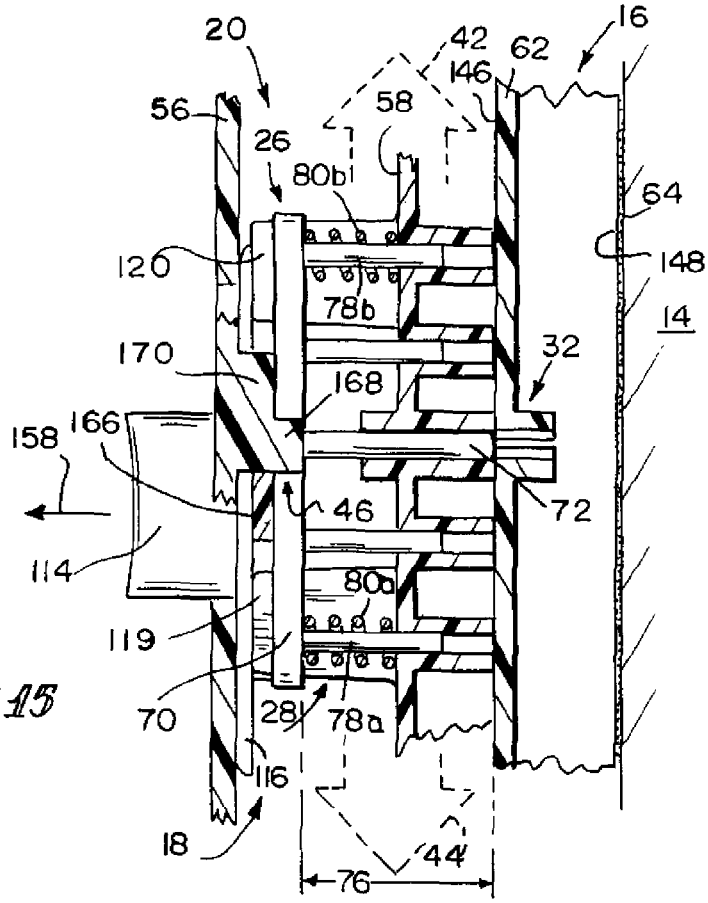

As shown in FIG. 8, rotation lock 24 includes anchor 26 and anchor return 28. Anchor return 28 is configured to apply a biasing force 158 in a direction away from barrier mount 58 toward lever-handle motion barrier 56 to bias anchor 26 into contact with position guide 46 as shown in FIGS. 11 and 15. Hand 50 of the user applies an actuation force 68 to anchor mover 48 to overcome biasing force 158 and moves anchor 26 from the lever-rotation blocking position shown in FIG. 12 toward the lever-rotation unblocking position shown in FIG. 14.

Anchor 26, as shown in FIG. 9, includes a pin-support platform 70 and an anchor pin 72. Anchor pin 72 is appended to pin-support platform 70 and arranged to extend toward anchor receiver 32 of blocker carrier 60. Pin-support platform 70 is arranged to lie in confronting relation with anchor mover 48. Pin-support platform 70 is positioned to lie in spaced-apart relation to blocker carrier 60 a first distance 75 upon movement of anchor 26 to the lever-rotation blocking position as shown in FIG. 11. Pin-support platform 70 is positioned to lie in spaced-apart relation to blocker carrier 60 a relatively larger second distance 76 upon movement of anchor 26 to the lever-rotation unblocking position as shown in FIG. 15. Position guide 46 cooperates with anchor mover 48 to keep anchor 26 in the appropriate user-selected position.

Anchor return 28 is constrained normally to urge anchor 26 and consequently anchor-mover button 112 upwardly into engagement with position guide 46 retaining anchor in one of the user selected positions. As shown in FIG. 9, anchor return 28 includes a pair of spring-mount posts 78*a*, 78*b* appended to pin-support platform 70 and a pair of companion return springs 80*a*, 80*b* mounted around spring-mount post 78*a*, 78*b*. Spring-mount posts 78*a*, 78*b* are arranged to extend toward blocker carrier 60 and are positioned to lie in spaced-apart relation to one another such that anchor pin 72 is positioned to lie between spring-mount posts 78*a*, 78*b* as shown in FIGS. 11, 12, 14, and 15.

Illustratively, anchor return 28 is positioned to lie within lever-handle motion barrier 56 as suggested in FIG. 9. Lever-handle motion barrier 56, as shown in FIGS. 1 and 2 includes a first interior wall 81 positioned to lie a first radial distance 83 from rotation axis 22, a second exterior wall 82 positioned to lie a relatively larger second radial distance 84 from rotation axis 22, and top wall 54. First interior wall 81, second exterior wall 82, and top wall 54 cooperate to define a rotation-lock space 86 therebetween. As illustratively shown in FIG. 9, a first position guide 45 is appended to first interior wall 81 and arranged to extend into rotation-lock space 86 toward second exterior wall 82. Illustratively, second position guide 46 may be placed on second exterior wall 82 opposite first position guide 46 as shown in phantom in FIGS. 10 and 13.

Figure 6:
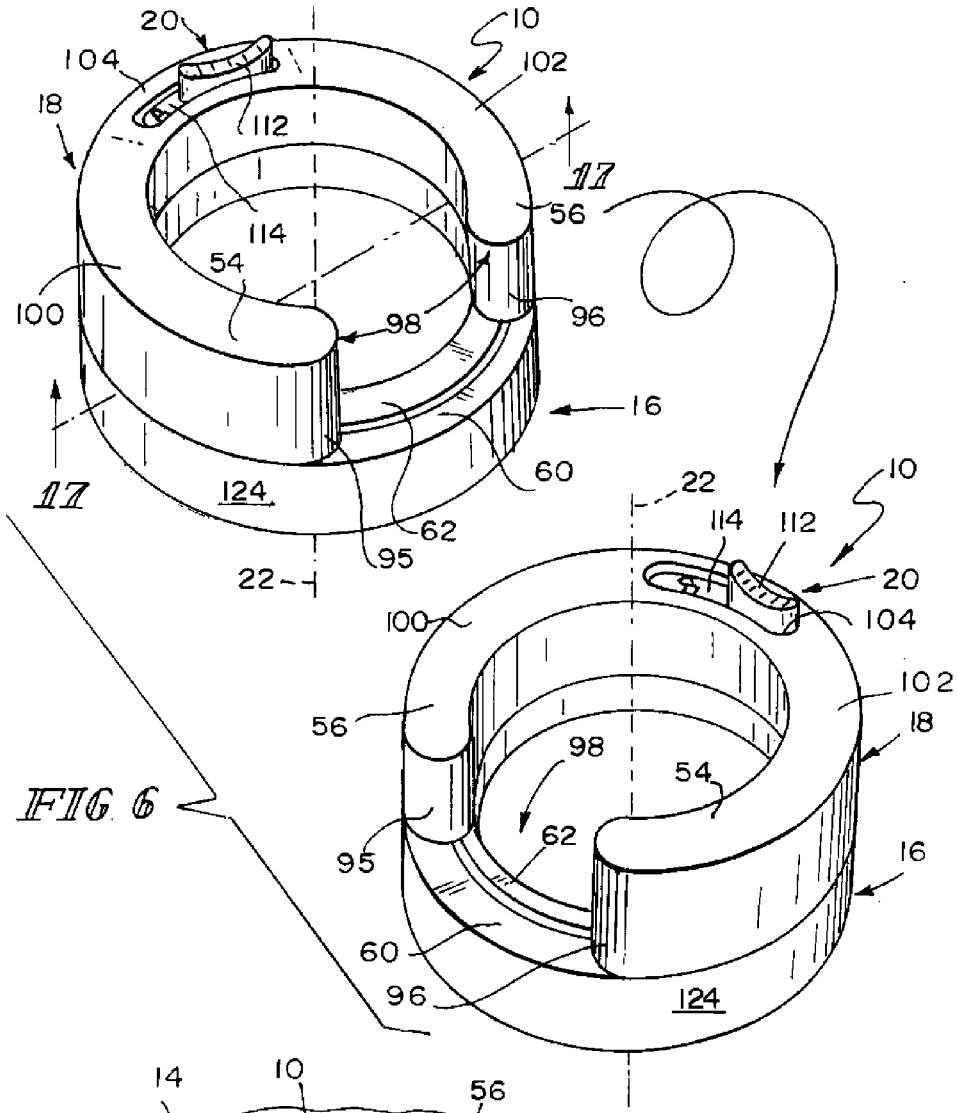
FIG. 6 is a perspective view of the lever-handle lock of FIG. 1 showing the lever-handle lock configured for use with a right-hand lever handle being re-configured for use with a left-hand lever handle by rotating the lever-handle lock 180 degrees relative to the door.
Figure 7:
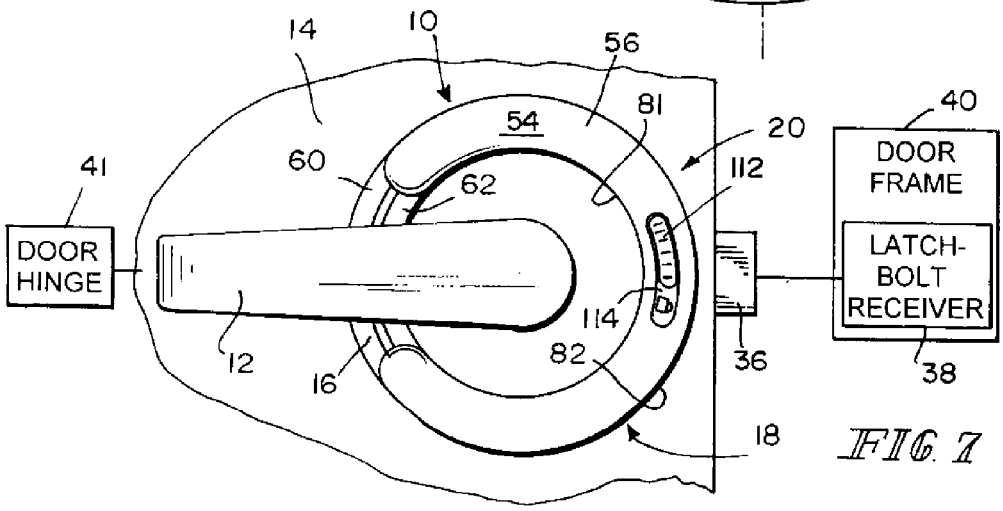
FIG. 7 is a plan view of the lever-handle lock of FIG. 6 coupled to a door and configured to block rotation of a left-hand lever handle.

Lever-handle motion barrier 56 further includes a first end 95 and a second end 96 defining a lever-handle gap 98 therebetween. First end 95 and second end 96 cooperate to interconnect first interior wall 81 and second exterior wall 82 to form a monolithic member arranged to have a circular C shape. As suggested in FIG. 6, lever-handle motion barrier 56 is formed of three portions, a first curved portion 100 having first end 95, a second curved portion 102 having second end 96, and a curved slot portion 104 having first slot 52. Curved slot portion 104 is positioned to lie between first curved portion 100 and second curved portion 102 to cause first slot 52 to be positioned to lie opposite lever-handle gap 98 as shown in FIG. 6.

Figure 10:
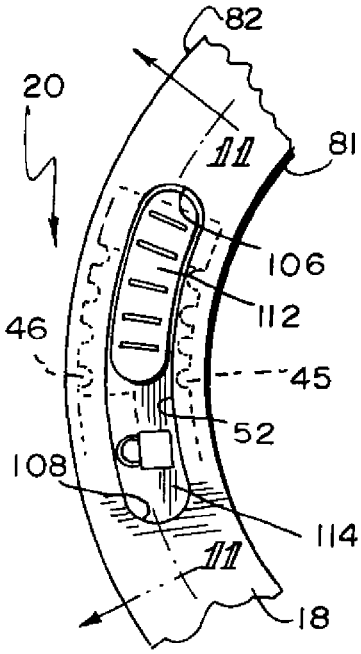
FIGS. 10-15 show an illustrative series of steps required to move the anchor from the lever-rotation blocking position illustrated in FIGS. 1 and 2 to the lever-rotation unblocking position illustrated in FIG. 3 so that a user may rotate the lever handle from the door-locking position to the door-unlocking position as illustrated in FIGS. 4 and 5.
Figure 13:
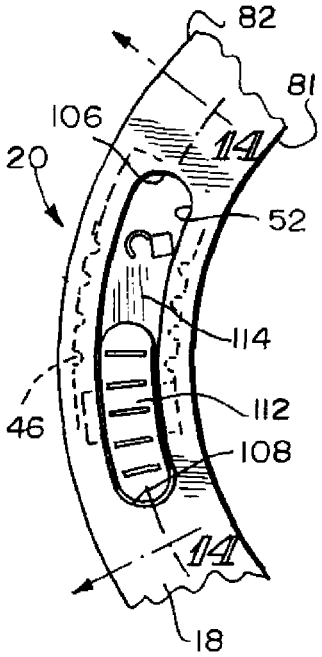
Figure 14:
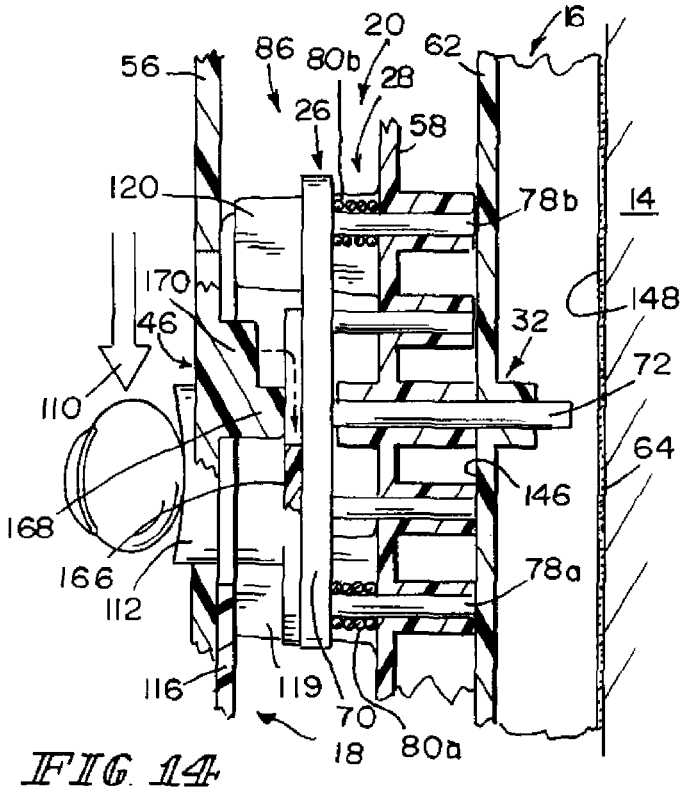

First slot 52 of lever-handle motion barrier 56, as shown in FIGS. 2 and 3, is defined by a locked-end stop 106 and an unlocked-end stop 108. Locked-end stop 106 is positioned to lie in spaced-apart relation to unlocked-end stop 108 such that first slot 52 is defined therebetween. Illustratively, first slot 52 has an arcuate shape as shown in FIGS. 10 and 13. Anchor mover 48 is arranged to mate with locked-end stop 106 when anchor 26 is in the lever-rotation blocking position as shown in FIG. 2. Anchor mover 48 moves illustratively in an arcuate path in an unlocked direction 110 (counter-clockwise) toward unlocked-end stop 108 in response to anchor 26 being moved to the lever-rotation unblocking position as shown in FIG. 3.

Figure 12:
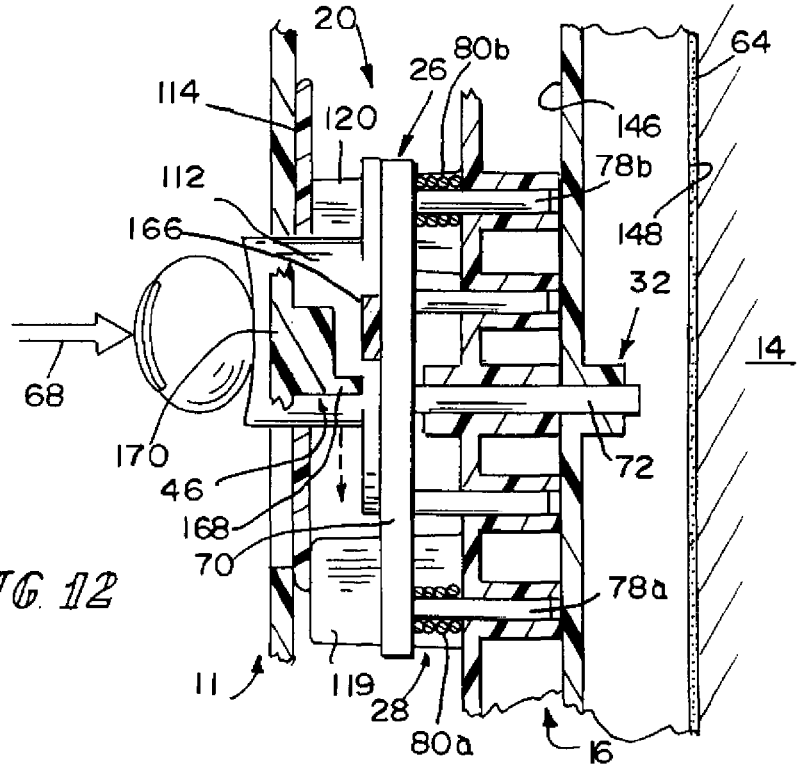

Anchor mover 48, as shown in FIG. 9, includes an anchor-mover button 112 and a button-cover plate 114. Button-cover plate 114 is arranged to lie in confronting relation with top wall 54 of lever-handle motion barrier 56 and is positioned to lie within rotation-lock space 86. Anchor-mover button 112 is arranged to lie in confronting relation with pin-support platform 70 of anchor 26 as shown in FIGS. 11 and 12. Anchor-mover button 112 is further arranged to extend away from anchor 26 through a second slot 116 formed in button-cover plate 114 and then through first slot 52 of top wall 54.

As shown in FIGS. 9, 11, 12, 14, and 15, anchor-mover button 112 includes a first guide tab 165 and a second guide tab 166. First guide tab 165 is arranged to extend toward first interior wall 81 of lever-handle motion barrier 56 to engage a first position guide 45 appended to first interior wall 81. Illustratively, second guide tab 166 is arranged to extend toward second exterior wall 82 and is configured to engage second position guide 46 appended to second exterior wall 82. Position guides 45, 46 cooperate with guide tabs 165, 166 to retain anchor-mover button in the user-specified location as shown in FIGS. 11, 12, 14, and 15.

As suggested in FIGS. 11, 12, 14, and 15, position guides 45, 46 are substantially identical and only second position guide 46 will be discussed in detail. Illustratively, position guide 46 includes a position-restraint wall 168 and a position-restraint platform 170. Position-restraint wall 168 is appended to position-restraint platform 170. Position guide 45 as a unit is appended to top wall 54 and second exterior wall 82 as suggested in FIGS. 11 and 12. When anchor 26 is in the lever-rotation blocking position, second guide tab 166 is arranged to lie in confronting relation with both position-restraint wall 168 and position-restraint platform 170 as shown in FIG. 11. When anchor 26 is in the lever-rotation unblocking position, first guide tab 165 is arranged to lie in confronting relation with button-cover plate 114 and position-restraint wall 168 as shown in FIG. 15.

Button-cover plate 114, as suggested in FIGS. 10 and 13, is visible partly through first slot 52. Illustratively, button-cover plate 114 is formed to include a closed-lock icon 160 on one end and an opened-lock icon 162 on the opposite end. When anchor 26 is in the lever-rotation blocking position, closed-lock icon 160 is visible through first slot 52. When anchor 26 is in the lever-rotation unblocking position, opened-lock icon 162 is visible through first slot 52. Closed-lock icon 160 and opened-lock icons 162 communicate to user the position of anchor 26 visually.

Barrier mount 58, as shown in FIG. 9, is arranged to lie substantially within rotation-lock space 86. Illustratively, a set of five screws 88 are used to couple barrier mount 58 to lever-handle motion barrier 56 as suggested in FIG. 9. Barrier mount 58 includes a mount ring 90, an anchor guide 92, and an annular guide 94. Anchor guide 92 is appended to a top surface of mount ring 90 and is arranged to extend upwardly into rotation-lock space 86 toward top wall 54 of lever-handle motion barrier 56 as shown in FIG. 9. Annular guide 94 is appended to a bottom surface opposite top surface of mount ring 90 and is arranged to extend downwardly into blocker-support base 16 to constrain barrier mount 58 to rotate about rotation axis 22 and engage blocker mover 66 as suggested in FIGS. 17 and 18.

Anchor Guide 92, as shown in FIG. 9, is formed to include a pair of first inner tabs 117, 118 appended to mount ring 90 a first distance from rotation axis 22 and a pair of second outer tabs 119, 120 appended to mount ring 90 a relatively larger second distance from rotation axis 22. As suggested in FIG. 9, pin-support platform 70 of anchor 26 is positioned to lie between the pair of first inner tabs 117, 118 and the pair of second outer tabs 119, 120. The tabs 117, 118, 119, 120 cooperate to constrain anchor 26 to move in an up-and-down direction parallel to rotation axis 22.

As shown in FIG. 9, blocker carrier 60 includes a circular inner carrier wall 123 positioned to lie a first distance from rotation axis 22 and a circular outer carrier wall 124 positioned to lie a relatively larger second distance from rotation axis 22. Stationary carrier foundation 62 includes a coupling disc 128 arranged to lie in confronting relation with foundation fastener 64 and an interior wall 126 appended to coupling disk 128. Interior wall 126 is arranged such that circular inner carrier wall 123 is positioned to lie between interior wall 126 and circular outer carrier wall 124 when assembled.

Interior wall 126 of stationary carrier foundation 62 and circular inner carrier wall 123 define a substantially cylindrical guide channel 74 therebetween. Guide channel 74, as suggested in FIGS. 17 and 18, permits annular guide 94 to extend into guide channel 74. Guide channel 74 further opens into a blocker-mover space 122 defined by coupling disk 128 on the bottom, circular inner and outer carrier walls 123, 124, and an upper-support wall 130 interconnecting circular inner and outer carrier walls 123, 124 as suggested in FIG. 9.

Annular guide 94 of barrier mount 58 includes a thin-guide ring 132 and first and second blocker-return tabs 133, 134 as suggested in FIG. 9. Thin-guide ring 132 is appended to mount ring 90 and arranged to extend into guide channel 74 to constrain barrier mount 58 to rotate about rotation axis 22. Blocker-return tabs 133, 134 are appended to thin-guide ring 132 and positioned to lie in circumferentially spaced-apart relation to one-another. Illustratively, first blocker-return tab 133 is configured to engage blocker mover 66 when lever-handle motion barrier 56 rotates in clockwise direction 42 toward the door-unlocking position as suggested in FIGS. 4, 17, and 18. Second blocker-return tab 134 is configured to engage blocker mover 66 when lever-handle motion barrier 56 rotates in counter-clockwise direction 44 toward the door-unlocking position as suggested in FIG. 5.

Blocker mover 66 is configured to urge lever-handle rotation blocker 18 to move from the door-locking position toward the door-unlocking position. Illustratively the door-unlocking position may be achieved by rotation in clockwise direction 42 (FIG. 4) or counter-clockwise direction 44 (FIG. 5). Blocker mover 66 is configured to supply a biasing torque 164 in response to rotation in either clockwise direction 42 or counter-clockwise direction 44.

Figure 18:
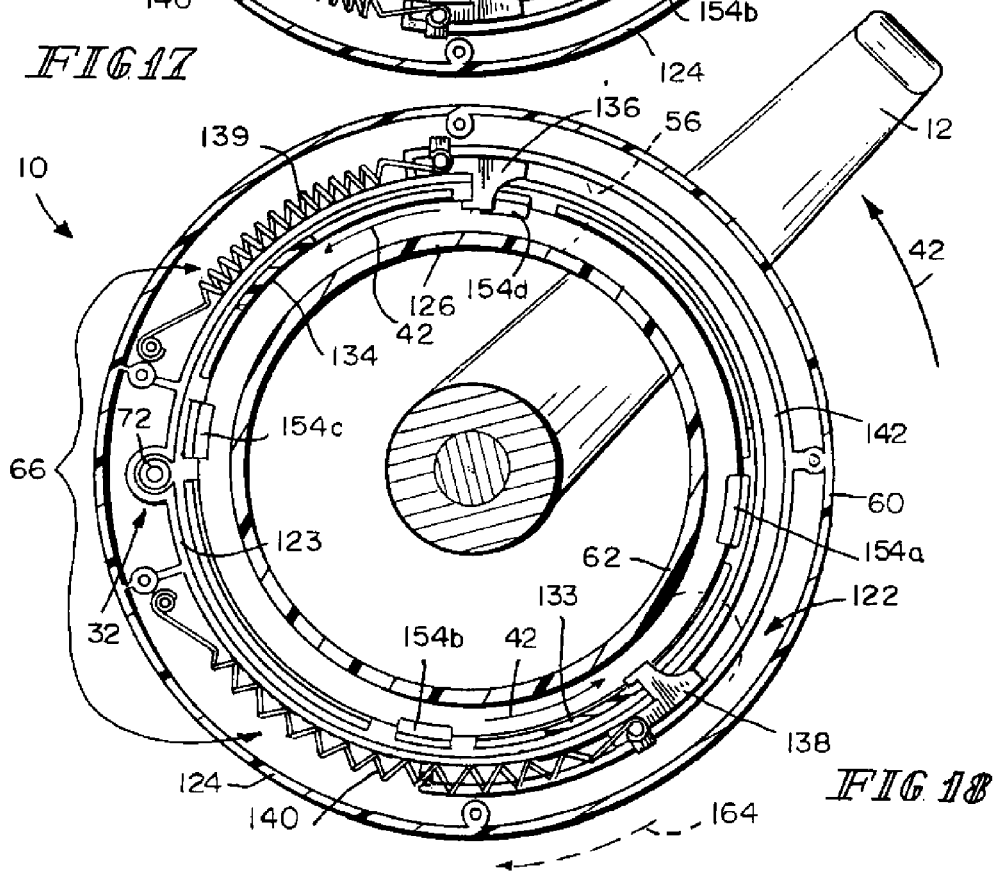
FIG. 18 is a sectional view similar to FIG. 17 showing that the lever handle has been rotated in the counter-clockwise direction similar to FIG. 5 to cause the lever-handle rotation blocker to move in unison with the lever handle and showing that a blocker-return tab appended to the barrier mount has engaged the counter-clockwise mover thereby elongating the return spring and providing a biasing torque to return the lever-handle rotation blocker to the door-locking position.

Blocker mover 66, as shown in FIG. 9, illustratively includes a clockwise mover 136 configured to mate with first blocker-return tab 133 to bias lever-handle rotation blocker 18 into the door-locking position as shown in FIG. 18 and a counter-clockwise mover 138 configured to mate with second blocker-return tab 134 to bias lever-handle rotation blocker 18 into the door-locking position. Clockwise mover 136 is coupled to a first return spring 139 that interconnects clockwise mover 136 to blocker carrier 60 and provides the biasing torque when lever-handle rotation blocker 18 is rotated in clockwise direction 42. Counter-clockwise mover 138 is coupled to a second return spring 140, included in blocker mover 66, and provides the biasing torque when lever-handle rotation blocker 18 is rotated in counter-clockwise direction 44.

Figure 17:
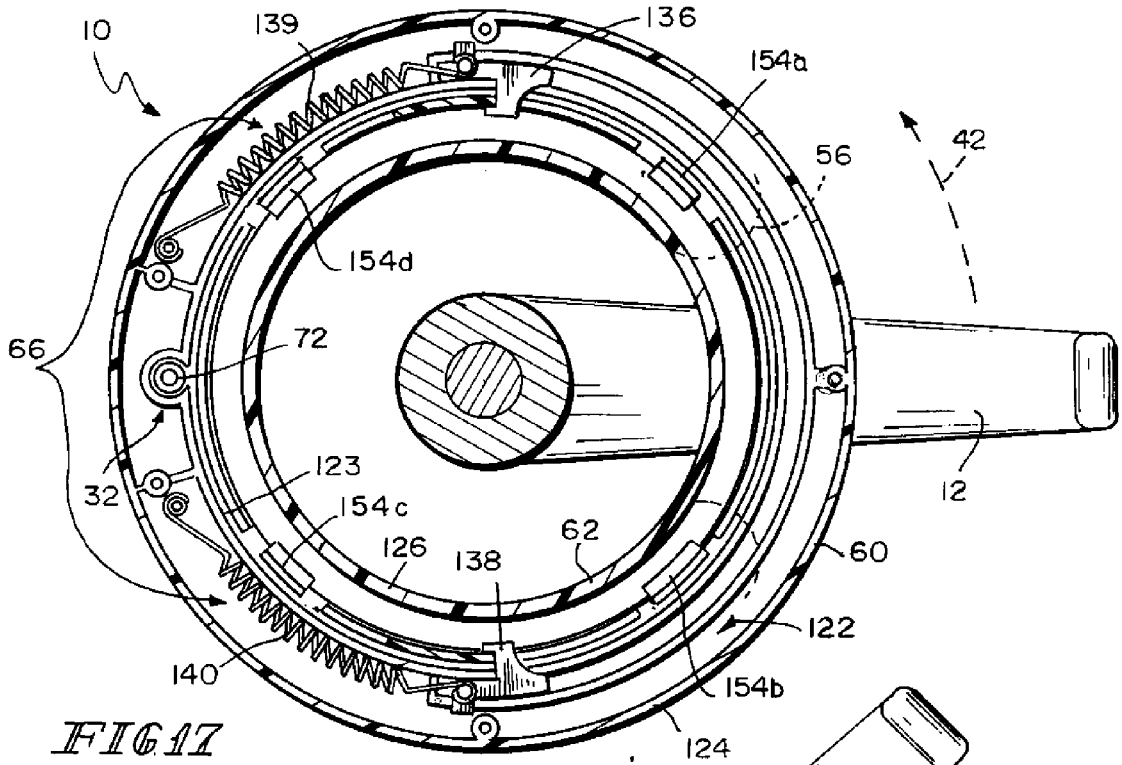
FIG. 17 is a sectional view taken along line 17-17 of FIGS. 1 and 6 showing that the blocker mover includes a clockwise mover at the top of the lever-handle lock and a counter-clockwise mover at the bottom of the lever-handle lock and showing that each of the movers is coupled to the blocker carrier by a return spring.

Clockwise mover 136 and counter-clockwise mover 138 are positioned to lie within a mover race 142 formed in blocker carrier 60 as shown in FIGS. 9, 17, and 18. Furthermore, movers 136 and 138 are arranged to lie on a mover-support platform 144 included in stationary carrier foundation 62. Movers 136 and 138 are constrained to move within mover race 142 by upper-support wall 130 above and mover-support platform 144 below.

Lever-handle lock 10 is operated by a user engaging rotation-lock actuator 30 to move anchor 26 into anchor receiver 32 formed in blocker carrier 60 to block rotation of lever handle 12. Anchor 26 is constrained to move substantially vertically between the lever-rotation blocking position and the lever-rotation unblocking positions. Blocker-support base 16, as illustrated in FIGS. 11, 12, 14, and 15 is formed to include a top surface 146 through which anchor 26 passes through into anchor receiver 32.

As illustrated in FIGS. 11, 12, 14, and 15, blocker-support base 16 is formed to include top surface 146 arranged to face toward lever-handle rotation blocker 18 and a bottom surface 148 positioned to lie in spaced-apart relation to top surface 146. Bottom surface 148 is arranged to face away from lever-handle rotation blocker 18 toward door 14. As shown in FIG. 9, top surface 146 is formed to include an aperture 150 opening into anchor receiver 32 and guide channel 74. Illustratively, an anchor passageway 152 is formed in mount ring 90 of barrier mount 58 to allow anchor 26 to pass through barrier mount 58 and communicate with anchor receiver 32. As suggested in FIG. 9, anchor passageway 152 is aligned with anchor receiver 32 and aperture 150.

As shown in FIG. 9 and suggested in FIGS. 17 and 18, barrier mount 58 further includes at least one retention tab 154. Illustratively, barrier mount 58 includes four retention tabs 154*a*, 154*b*, 154*c*, and 154*d*. Each retention tab is substantially identical to the other retention tabs, and therefore, only retention tab 154*a* will be discussed in detail. Retention tab 154*a* is formed in mount ring 90 and configured to mate with a retention flange 156 formed in stationary carrier foundation 62.

Illustratively, retention tab 154 is configured to deflect inwardly toward rotation axis 22 during installation of lever-handle rotation blocker 18 onto blocker-support base 16.

Retention tab 154 deflects inwardly toward rotation axis 22 when passing over retention flange 156 of stationary carrier foundation 62. Retention flange 156 is appended to interior wall 126 and arranged to lie as a part of top surface 146. Retention flange 156 is arranged to extend outwardly from rotation axis 22 and to mate with retention tab 154.

As shown in FIGS. 1 and 9 and suggested in FIG. 8, foundation fastener 64 is configured to couple stationary carrier foundation 62 to door 14. Illustratively foundation fastener 64 is an adhesive pad, but may be any suitable alternative.

Lever-handle lock 10 is configured for use with a right-hand lever handle 12 as shown in FIG. 1. Lever-handle lock 10 may be configured for use with a left-hand lever handle as shown in FIG. 6 by rotating lever-handle lock 10 by 180 degrees relative to door 14. Lever-handle rotation blocker 18 is capable of rotating about rotation axis 22 in one of clockwise direction 42 and counter-clockwise direction 44 thus allowing lever-handle lock 10 to be mounted on either a left-hand lever handle or a right-hand lever handle without modification. Lever-handle lock 10 further allows mounting on door 14 without removal of lever handle 12 during installation.

Figure 16:
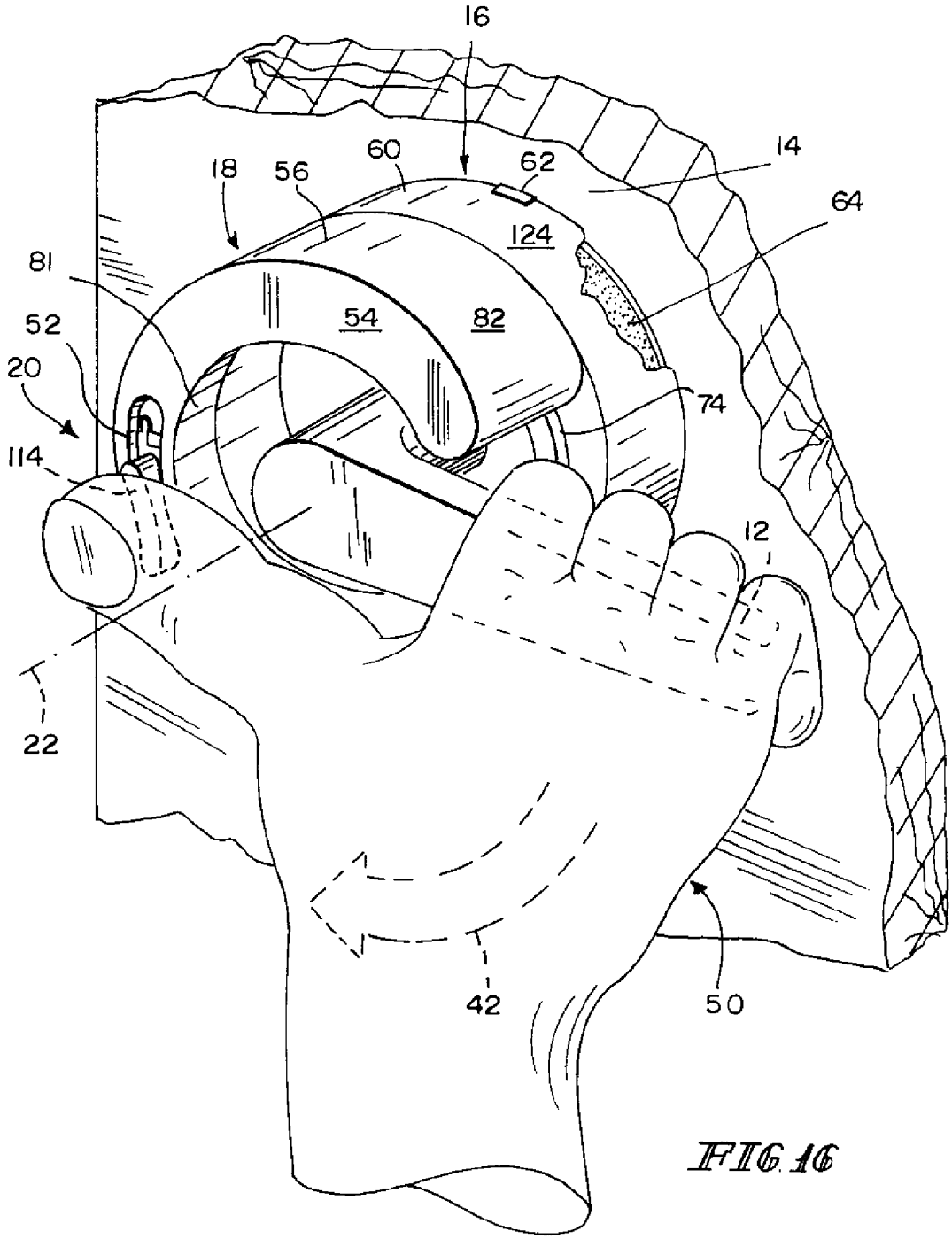
FIG. 16 is a perspective view of the lever-handle lock of FIG. 1 showing that a hand of a user may move the anchor-mover button from the lever-rotation blocking position to the lever-rotation unblocking position with a thumb and suggesting that after the anchor is in the lever-rotation unblocking position, the lever handle may be rotated to the door-unlocking position so that the door may be opened.

Illustratively, lever-handle lock 10 is installed on door 14 by slipping lever-handle lock 10 over lever handle 12. Anchor 26, included in lever-handle lock 10, can be moved from the lever-rotation blocking position to the lever-rotation unblocking position by the user using one hand 50 as shown in FIG. 16. Illustratively, the user uses their thumb to engage rotation-lock actuator 30 to move anchor to the lever-rotation unblocking position and the remainder of their hand to rotate lever-handle 12 from the door-locking position to the door-unlocking position as suggested in FIG. 16 and shown in FIGS. 2-5.

The invention claimed is:

1. A lock for a lever handle mounted on a door, the lock comprising a blocker-support base adapted to mount on a door in a fixed position to surround a lever handle coupled to the door and the blocker-support base is formed to include an anchor receiver, a lever-handle rotation blocker mounted on the blocker-support base to rotate about a rotation axis between a door-locking position wherein the lever-handle rotation blocker is adapted to block rotation about the rotation axis of a lever handle carried on a door to keep the door in mating contact with a door frame and a door-unlocking position wherein the lever-handle rotation blocker is adapted to allow rotation about the rotation axis of a lever handle carried on a door to allow the door to move out of mating contact with a door frame, and a blocker-movement controller including a rotation lock including an anchor and an anchor return configured to apply a biasing force to the anchor, the anchor being coupled to the lever-handle rotation blocker and configured to move from a lever-rotation blocking position wherein the anchor is arranged to extend into the anchor receiver formed in the blocker-support base toward a lever-rotation unblocking position wherein the anchor is positioned to lie outside the anchor receiver, and actuator means for moving the anchor against the biasing force to cause the anchor to move out of the anchor receiver to free the lever-handle rotation blocker to rotate about the rotation axis in response to rotation of the lever handle about the rotation axis from the door-locking position toward the door-unlocking position.

2. The lock of claim 1, wherein the actuator means includes a position guide appended to the lever-handle rotation blocker and an anchor mover coupled to the lever-handle rotation blocker and arranged to extend away from the blocker-support base through a first slot formed in a top wall of the lever-handle rotation blocker.

3. The lock of claim 2, wherein the lever-handle rotation blocker further includes a first interior wall positioned to lie a first radial distance from the rotation axis and a second exterior wall positioned to lie a relatively larger second radial distance from the rotation axis, the first interior wall, the second exterior wall, and the top wall cooperate to define a rotation-lock space therebetween, and the position guide is appended to the first interior wall of the lever-handle rotation blocker and arranged to extend into the rotation-lock space toward the second exterior wall to engage and retain the anchor mover in the lever-rotation blocking position.

4. The lock of claim 3, wherein the anchor mover includes a anchor-mover button and a button-cover plate, the button-cover plate is arranged to lie in confronting relation with the top wall of the lever-handle rotation blocker and positioned to lie within the rotation-lock space, and the anchor-mover button is arranged to lie in confronting relation with the anchor and arranged to extend away from the anchor through a second slot formed in the button-cover plate and through the first slot formed in the lever-handle rotation blocker.

5. The lock of claim 4, wherein the anchor mover further includes a guide tab appended to the anchor-mover button and arranged to extend away from the anchor-mover button toward the first interior wall, wherein the guide tab is positioned to lie in confronting relation with the button-cover plate in response to the anchor moving toward the lever-rotation blocking position, and wherein the guide tab is positioned to lie in spaced-apart relation to the button-cover plate in response to the anchor moving toward the lever-rotation unblocking position.

6. The lock of claim 2, wherein the top wall of the lever-handle rotation blocker is formed to include a locked-end stop and an unlocked-end stop positioned to lie in spaced apart relation to the locked-end stop to define the first slot therebetween, the anchor mover is constrained to move in an arcuate path from the locked-end stop toward the unlocked-end stop upon movement of the anchor from the lever-rotation blocking position toward the lever-rotation unblocking position.

7. The lock of claim 6, wherein the anchor includes a pin-support platform and an anchor pin appended to the pin-support platform and arranged to extend toward the anchor receiver formed in the blocker-support base, the pin-support platform is positioned to lie in spaced-apart relation to the blocker-support base a first distance upon movement of the anchor to the lever-rotation blocking position, the pin-support platform is positioned to lie in spaced-apart relation to the blocker-support base a relatively larger second distance upon movement of the anchor to the lever-rotation unblocking position, and the pin-support platform is arranged to lie in confronting relation with the anchor mover.

8. The lock of claim 7, wherein the anchor return includes a spring-mount post appended to the pin-support platform and arranged to extend toward the blocker-support base, the spring-mount post is positioned to lie in spaced-apart relation to the anchor pin, and a return spring is mounted around the spring-mount post and configured to provide the biasing force in a direction parallel to the rotation axis and away from the blocker-support base toward the lever-handle rotation blocker.

9. The lock of claim 2, wherein the lever-handle rotation blocker includes a first end and a second end defining a lever-handle gap therebetween, the lever-handle rotation blocker includes a first curved portion, a second curved portion, and a curved slot portion positioned to lie between and arranged to interconnect the first curved portion and the second curved portion, and the first slot is formed in the curved slot portion opposite the lever-handle gap.

10. The lock of claim 1, wherein the blocker-movement controller further includes blocker mover means for providing a biasing torque to the lever-handle rotation blocker to cause the lever-handle rotation blocker to move from the door-unlocking position toward the door-locking position so that the actuator means can move the anchor from the lever-rotation unblocking position to the lever-rotation blocking position.

11. The lock of claim 10, wherein the blocker mover means is positioned to lie within a blocker-mover space formed in the blocker-support base, the lever-handle rotation blocker further includes a first blocker-return tab extending through a guide channel formed in the blocker-support base and configured to open into the blocker-mover space, and the first blocker-return tab is configured to engage the blocker mover means upon movement of the lever-handle rotation blocker toward the door-unlocking position.

12. The lock of claim 11, wherein the blocker mover means includes a clockwise mover configured to mate with the first blocker-return tab and a first return spring arranged to interconnect the clockwise mover to the blocker-support base to provide the biasing torque.

13. The lock of claim 12, wherein the blocker mover means further includes a counter-clockwise mover configured to mate with a second blocker-return tab appended to the lever-handle rotation blocker opposite the first blocker-return tab and a second return spring arranged to interconnect the counter-clockwise mover to the blocker-support base and configured to provide the biasing torque.

14. The lock of claim 11, wherein the actuator means includes a position guide appended to the lever-handle rotation blocker and an anchor mover coupled to the lever-handle rotation blocker and arranged to extend away from the blocker-support base through a first slot formed in a top wall of the lever-handle rotation blocker.

15. The lock of claim 14, wherein the blocker-support base is formed to include a top surface arranged to face toward the lever-handle rotation blocker and a bottom surface positioned to lie in spaced-apart relation from the top surface and arranged to face away from the lever-handle rotation blocker and the top surface is formed to include an aperture opening into the anchor receiver and the guide channel.

16. The lock of claim 1, wherein the lever-handle rotation blocker includes a barrier mount coupled to the blocker-support base to rotate about the rotation axis and a lever-handle motion barrier coupled to the barrier mount to move therewith.

17. The lock of claim 16, wherein the actuator means is arranged to extend away from the barrier mount and through a first slot formed in the lever-handle motion barrier, the anchor is arranged to extend away from the lever-handle motion barrier toward the anchor receiver, and the anchor is arranged to extend through an anchor passageway formed in the barrier mount and aligned with the anchor receiver below.

18. The lock of claim 16, wherein the barrier mount includes at least one retention tab arranged to extend into a guide channel formed in the blocker-support base to mate with a retention flange included in the blocker-support base and the retention tab is configure to allow rotation of the barrier mount about the rotation axis.

19. A lock for a lever handle mounted on a door, the lock comprising a blocker-support base adapted to mount on a door in a fixed position to surround a lever handle coupled to the door and the blocker-support base is formed to include an anchor receiver, a lever-handle rotation blocker including a barrier mount coupled to the blocker-support base to rotate about a rotation axis between a door-locking position and a door-unlocking position and a lever-handle motion barrier coupled to the barrier mount to move therewith, and a blocker-movement controller including a rotation lock coupled to the barrier mount and configured to move from a lever-rotation blocking position wherein the rotation lock is arranged to interconnect the barrier mount and the blocker-support base and a lever-rotation unblocking position wherein the rotation lock is positioned to lie outside the blocker-support base to cause the barrier mount to rotate about the rotation axis in response to application of a user-supplied torque to the lever-handle motion barrier and a rotation-lock actuator coupled to the lever-handle motion barrier to move relative to the lever-handle motion barrier.

20. The lock of claim 19, wherein the rotation lock includes an anchor positioned to lie in a rotation-lock space defined by the barrier mount and the lever-handle motion barrier, the anchor is arranged to extend into an anchor receiver formed in the blocker-support base, and an anchor return configured to apply a biasing force to the anchor to move the anchor away from the barrier mount.

21. The lock of claim 19, wherein the blocker-movement controller further includes a blocker mover configured to provide a biasing torque to the lever-handle rotation blocker to cause the lever-handle rotation blocker to move from the door-unlocking position toward the door-locking position to allow the rotation-lock actuator to move the anchor from the lever-rotation unblocking position to the lever-rotation blocking position.

22. A lock for a lever handle mounted on a door, the lock comprising a blocker-support base, a lever-handle rotation blocker mounted on the blocker-support base to rotate about a rotation axis between a door-locking position and a door-unlocking position, and an anchor coupled to the lever-handle rotation blocker and configured to move in a direction parallel to the rotation axis from a lever-rotation blocking position wherein the anchor is arranged to interconnect the lever-handle rotation blocker to the blocker-support base to a lever-rotation unblocking position wherein the anchor is positioned to lie outside the blocker-support base to cause the lever-handle rotation blocker to rotate about the rotation axis in response to application of a user-supplied torque to the lever-handle motion barrier.

* * * * *